United States Patent [19]

Dohi et al.

[11] 4,132,610

[45] * Jan. 2, 1979

[54] METHOD OF BRIGHT ELECTROPLATING OF TIN-LEAD ALLOY

[75] Inventors: Nobuyasu Dohi, Kobe; Keigo Obata, Himeji, both of Japan

[73] Assignee: Hyogo Prefectural Government, Kobe, Japan

[ * ] Notice: The portion of the term of this patent subsequent to Jan. 2, 1995, has been disclaimed.

[21] Appl. No.: 687,582

[22] Filed: May 18, 1976

[51] Int. Cl.[2] ..... C25D 3/60

[52] U.S. Cl. ..... 204/43 S

[58] Field of Search ..... 204/43 S, 53, 54 R, 204/54 L, 123

[56] References Cited

U.S. PATENT DOCUMENTS 3,905,878 9/1975 Dohi et al. ..... 204/43 S

FOREIGN PATENT DOCUMENTS 1151460 5/1969 United Kingdom ..... 204/43 S

*Primary Examiner*—G. L. Kaplan

[57] ABSTRACT

A method of electroplating of tin-lead alloys, which comprises using a solution containing hydroxyalkyl sulfonic acid and its divalent tin salts and lead salts, said solution being mixed with reaction products of acetaldehyde with O-toluidine as additives for brightening.

1 Claim, No Drawings

METHOD OF BRIGHT ELECTROPLATING OF TIN-LEAD ALLOY

BACKGROUND OF THE INVENTION

The present invention relates to a method of bright electroplating tin-lead alloys, which is characterized by using hydroxyalkyl sulfonates as the commonly soluble complex salts of divalent tin and lead, and by using reaction products of acetaldehyde with O-toluidine as additives to the solution containing the above complex salts, thereby providing tin-lead alloy electrodeposits having desirable or excellent brightness, without exhausting poisonous chemicals which cause pollution.

Recently an electroplate of tin-lead alloy has been widely utilized on electric and electronic parts or elements as coating to improve soldering and for etching-resistoring; particularly a bright electroplate is admired.

At present, the plating solution containing borofluorate or phenol sulfonate is used for industries. But both of them contain poisonous chemicals which cause pollution in waste solution.

Namely, when using borofluorate, the drainage is contaminated with fluorine, a component of borofluoric acid, which is very poisonous and; when using aromatic sulfonates such as phenolsulfonate, the drainage is contaminated with phenols and phenolic compounds which cause public pollution and cyclic compounds containing benzene, which are chemically and biologically irresolvable.

Although these chemicals can be treated by a higher technique of resolvement, much cost is needed for equipment and treatment.

From the viewpoint of pollution as stated above, when using phenol sulfonates which are les poisonous that borofluorates, less bright electrodeposits may be obtained in the beginning of plating or in barrel-plating when electric current density is low.

SUMMARY OF THE INVENTION

This invention is to eliminate the defects inherent to the plating solutions of borofluorates or phenol sulfonates. To this end, a major object of the invention is to provide a method of bright electroplating of tin-lead alloy, without using such chemicals, to obtain excellent brightness over a wide range of current density regardless of whether it is rack-plating or barrel-plating, and to deposit a composition having a ratio of tin to lead, which is almost equal to that of the plating solution.

DETAILED DESCRIPTION OF THE INVENTION

The plating solution according to this invention contains hydroxyalkyl sulfonic acid as represented by the general formula, $$C_nH_{2n+1}-\underset{\underset{OH}{|}}{CH}-C_mH_{2m}-SO_3H \text{ (n:0 - 2 and m: 1 - 3)},$$

and that of divelent tin and lead.

Several examples of hydroxyalkyl sulfonic acids which can be used in the present invention are shown as in the following table.

| | |
|---|---|
| $HOCH_2CH_2SO_3H$ | 2-hydroxyethyl sulfonic acid |
| $CH_3CH(OH)CH_2SO_3H$ | 2-hydroxypropyl sulfonic acid |
| $HOCH_2CH_2CH_2SO_3H$ | 3-hydroxypropyl sulfonic acid |
| $CH_3CH_2CH(OH)CH_2SO_3H$ | 2-hydroxybutyl sulfonic acid |
| $CH_3CH(OH)CH_2CH_2CH_2SO_3H$ | 4-hydroxypentyl sulfonic acid |

The following are examples showing the compositions of the solution and conditions of the plating. This invention is not limited to these examples, but the compositions and the conditions can be altered over an extended range for the aforesaid purpose of obtaining a desired bright electrodeposit of tin-lead alloy. In the following examples, /l (per liter) represents "every 1 liter of the plating solution."

EXAMPLE 1

| | |
|---|---|
| Compositions of the Plating Solution | |
| Divalent tin (used in the form of stannous 2-hydroxyethyl sulfonate) | 15g/l |
| Lead (used in the form of lead 2-hydroxyethyl sulfonate) | 10g/l |
| Free 2-hydroxyethyl sulfonic acid | 50g/l |
| Brightening agent (20% by weight solution of the precipitate which was extracted with isopropyl alcohol after the reaction of 5 mols of acetaldehyde with 1 mol of O-toluidine at a pH 10.0 - 10.5 at 15° C for 10 days) | 20ml/l |
| Surface-active agent (sulfopropylized addition product of 1 mol of nonylphenol with 13 mols of ethylene oxide) | 10g/l |
| Acetaldehyde (20%) | 5ml/l |
| Condition of Plating | |
| Temperature | 15° C |
| Current density | 3A/dm$^2$ |

EXAMPLE 2

| | |
|---|---|
| Compositions of the Plating Solution | |
| Divalent tin (used in the form of stannous 4-hydroxyethyl sulfonate) | 20g/l |
| Lead (used in the form of lead 4-hydroxypentyl sulfonate) | 15g/l |
| Free 4-hydroxypentyl sulfonic acid | 100g/l |
| Brightening agent (same as in Example 1) | 25ml/l |
| Surface-active agent (addition product of 1 mol of isooctyl alcohol with 15 mols of ethylene oxide) | 15g/l |
| Formalin (37%) | 5ml/l |
| Conditions of Plating | |
| Temperature | 25° C |
| Current density | 8A/dm$^2$ |

EXAMPLE 3

| | |
|---|---|
| Compositions of the Plating Solution | |
| Divalent tin (used in the form of stannous 2-hydroxypropyl sulfonate) | 25g/l |
| Lead (used in the form of lead 2-hydroxypropyl sulfonate) | 20g/l |
| Free 2-hydroxypropyl sulfonic acid | 150g/l |
| Brightening agent (same as in Example 1) | 40ml/l |
| Surface-active agent (addition product of 1 mol of ethylene oxide) | 20g/l |

-continued

| | |
|---|---|
| Formalin (37%) | 5ml/l |
| Conditions of Plating | |
| Temperature | 20° C |
| Current density | 10A/dm$^2$ |

With such compositions of solution, when the electroplating was carried out with the anode moved or the solution agitated slowly and when the barrel-plating was done, excellent bright deposition of tin-lead alloy was obtained in every case of the examples without lapsing or preliminary electrolysis.

As the result of the plating with various current densities, in rack-plating, bright deposits were obtained respectively in the range of current density of 0.5–10 A/dm$^2$ in Example 1, 1–10A/dm$^2$ in Example 2, 3–20 A/dm$^2$ in Example 3; in barrel-plating, respectively 1–15 A/dm$^2$ in Example 1, 1.5–15 A/dm$^2$ in Example 2, 4–20 A/dm$^2$ in Example 3.

When applying bright electroplating of tin-lead alloy by using the plating solution of phenol sulfonates for the prevention of fluorine pollution, it is known that bright deposit can be hardly obtained under as low current density as 1 A/dm$^2$ particularly in barrel-plating.

The surface-active agent and formalin or acetaldehyde are used as components of the plating solution in order to widen the range of current density in which good bright plating of alloy can be made. In more detail, the brightness was improved remarkably by formalin in the range of lower current density and by acetaldehyde in the range of higher current density.

In addition, although compositions of the plating solution and conditions in rack- and barrel-platings are described in the examples, this invention can be applied also in the continuous plating.

We claim:

1. a method of bright electroplating of tin-lead alloy which is characterized by using a plating solution containing hydroxyalkyl sulfonic acid and its divalent tin salts and lead salts, represented by the general formula, $$C_nH_{2n+1}-\underset{\underset{OH}{|}}{CH}-CmH_2m-SO_3H \text{ (n: 0 - 2, m: 1 - 3)},$$

said solution being mixed with reaction products of acetaldehyde with O-toluidine as additives for brightening.

* * * * *